US009612062B2

(12) United States Patent
Ri et al.

(10) Patent No.: US 9,612,062 B2
(45) Date of Patent: Apr. 4, 2017

(54) COOLING SYSTEM AND COOLING METHOD

(75) Inventors: Zui Ri, Tokyo (JP); Tatsuo Koizumi, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 165 days.

(21) Appl. No.: 13/618,489

(22) Filed: Sep. 14, 2012

(65) Prior Publication Data

US 2013/0067952 A1 Mar. 21, 2013

Related U.S. Application Data

(63) Continuation of application No. PCT/JP2010/002945, filed on Apr. 23, 2010.

(51) Int. Cl.

| | |
|---|---|
| ***F25B 9/00*** | (2006.01) |
| ***F25J 1/02*** | (2006.01) |
| ***F28F 9/00*** | (2006.01) |
| ***F25B 25/00*** | (2006.01) |
| ***H01F 6/04*** | (2006.01) |
| ***F25B 1/00*** | (2006.01) |

(Continued)

(52) U.S. Cl.

CPC ..... *F28F 9/00* (2013.01); *F25B 1/00* (2013.01); *F25B 25/005* (2013.01); *F25B 29/00* (2013.01); *H01F 6/04* (2013.01); *F25B 9/14* (2013.01); *F25B 9/145* (2013.01)

(58) Field of Classification Search

CPC .. F25B 9/10; F25B 9/00; F25B 23/006; F25B 15/10; F25B 9/002; F25B 9/12; F25B 9/14; F25J 1/02; F25J 1/0201; F25J 1/0202; F25J 1/0203; F25J 1/0204; F25J 1/0205; F25J 1/0206; F25J 1/0222; F25J 1/0224; F25J 1/0225; F25J 1/0221; F25J 2270/12

USPC ..... 62/614, 64, 115, 6, 606, 607, 608, 610, 62/51.2

See application file for complete search history.

(56) References Cited

U.S. PATENT DOCUMENTS 3,656,313 A * 4/1972 Low ..... F25B 9/10 62/475
4,421,464 A * 12/1983 Schmidt ..... F04B 15/08 310/27

(Continued)

FOREIGN PATENT DOCUMENTS

JP 2003-519772 A 6/2003
JP 2006-201018 A 8/2006

(Continued)

OTHER PUBLICATIONS

International Search Report mailed Jul. 20, 2010.
Office Action issued in Japanese Patent Application No. 2012-511422, dated Nov. 12, 2013.

*Primary Examiner* — Frantz Jules
*Assistant Examiner* — Erik Mendoza-Wilkenfe
(74) *Attorney, Agent, or Firm* — Michael Best & Friedrich LLP

(57) ABSTRACT

A cooling system for cooling a superconducting device by a low-temperature fluid is provided. A flow generator for producing a flow in the low-temperature fluid is provided in the cooling system. The low-temperature fluid flowing through the superconducting device is heated. The flow generator is used to produce a flow in the heated low-temperature fluid. The low-temperature fluid is cooled and supplied to the superconducting device.

6 Claims, 3 Drawing Sheets

(51) Int. Cl.
*F25B 29/00* (2006.01)
*F25B 9/14* (2006.01)

(56) References Cited

U.S. PATENT DOCUMENTS

| | | | | |
|---|---|---|---|---|
| 5,447,034 | A * | 9/1995 | Kuriyama | F16J 9/062 148/301 |
| 6,347,522 | B1 * | 2/2002 | Maguire | F25B 9/14 62/6 |
| 6,415,613 | B1 * | 7/2002 | Ackermann | F25B 9/00 62/259.2 |
| 6,615,591 | B1 * | 9/2003 | Kusada et al. | 62/51.2 |
| 7,052,047 | B1 * | 5/2006 | Box | F16L 37/248 285/123.15 |
| 7,295,010 | B2 * | 11/2007 | Fukuda et al. | 324/318 |
| 2005/0086974 | A1 * | 4/2005 | Steinbach | F25B 9/14 62/437 |
| 2006/0288731 | A1 * | 12/2006 | Atkins et al. | 62/457.9 |
| 2008/0307801 | A1 * | 12/2008 | Tanaka et al. | 62/51.1 |
| 2008/0314064 | A1 * | 12/2008 | Al-Eidan | F25B 13/00 62/324.6 |
| 2010/0103618 | A1 * | 4/2010 | Campbell et al. | 361/699 |

FOREIGN PATENT DOCUMENTS

| | | | |
|---|---|---|---|
| JP | 2008-215640 | A | 9/2008 |
| WO | WO 01/51863 | A1 | 7/2001 |

* cited by examiner

COOLING SYSTEM AND COOLING METHOD

BACKGROUND OF THE INVENTION

1. Field of the Invention

The present invention relates to a cooling system and a cooling method for cooling a superconducting device by using a low-temperature fluid.

2. Description of the Related Art

Superconducting devices such as superconducting magnets and superconducting motors are usually provided with a cooling system for maintaining a superconducting state. For example, there is known a low-temperature cooling system for cooling a superconducting rotary machine. In this cooling system, a pair of high-speed fans are provided in a cooler in order to circulate helium. These fans are mechanical means provided in a low-temperature environment for the purpose of providing necessary force to guide helium to a rotor assembly via a cryocooler.

SUMMARY OF THE INVENTION

According to one embodiment of the present invention, a cooling system for cooling a superconducting device by a low-temperature fluid is provided. The system includes: a coolant circuit including a coolant outlet configured to supply a low-temperature fluid to the superconducting device, a coolant inlet configured to receive the fluid flowing through the superconducting device, and a coolant line configured to connect the inlet and the outlet; a low-temperature chamber configured to accommodate a first part of the coolant line upstream of the coolant outlet, a first heat exchanger configured to cool the fluid flowing in the first part toward the coolant outlet, a second part of the coolant line downstream of the coolant inlet, and a second heat exchanger configured to heat the fluid flowing in the second part; and a flow generator provided outside the low-temperature chamber and located in a third part of the coolant line connecting the first part and the second part, the flow generator being configured to generate a flow in the coolant line.

According to one embodiment of the present invention, a cooling method for cooling a superconducting device by flowing a low-temperature fluid is provided. The method includes: heating the low-temperature fluid flowing through the superconducting device to a guaranteed operating temperature range of a flow generator; circulating the heated low-temperature fluid by using the flow generator; and cooling the low-temperature fluid and supplying the fluid to the superconducting device.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described by reference to the preferred embodiments. This does not intend to limit the scope of the present invention, but to exemplify the invention.

In reality, the reliability of mechanical elements in a low-temperature environment is not so high. If a trouble occurs in a mechanical element located in a low-temperature environment, the cooling performance may be lowered.

Accordingly, a purpose of the present invention is to provide a cooling system and a cooling method that are highly reliable.

According to one embodiment of the present invention, a flow generator for producing a flow in a coolant line is provided outside the low-temperature chamber of a cooling system. Since the flow generator is used outside the low-temperature environment, it is expected that the reliability is improved. In further accordance with the embodiment, a general-purpose flow generator that is not designed for use in a low-temperature environment but is highly reliable at a guaranteed operating temperature can be employed in a cooling system.

The cooling system may be provided with a coolant circuit including a coolant outlet for supplying low-temperature fluid to a superconducting device, a coolant inlet for receiving the fluid flowing through the superconducting device, and a coolant line connecting the inlet and the outlet. The low temperature chamber may accommodate a first part of the coolant line upstream of the coolant outlet, a first heat exchanger for cooling the fluid flowing in the first part toward the coolant outlet, a second part of the coolant line downstream of the coolant inlet, and a second heat exchanger for heating the fluid flowing in the second part. The flow generator may be provided in a third part of the coolant line connecting the first part and the second part.

According to another embodiment of the present invention, there is provided a cooling method for cooling a superconducting device by causing a low-temperature fluid to flow. This method comprises heating the low-temperature fluid flowing through the superconducting device to a guaranteed operating temperature of the flow generator, circulating the heated low-temperature fluid by using the flow generator, and cooling the low-temperature fluid to supply the cooled fluid to the superconducting device. This ensures that the low-temperature fluid used for cooling is heated to a guaranteed operating temperature of the flow generator before being circulated by the flow generator. As a result, the reliability of the flow generator and, ultimately, the cooling system is expected to be improved.

Figure 1:
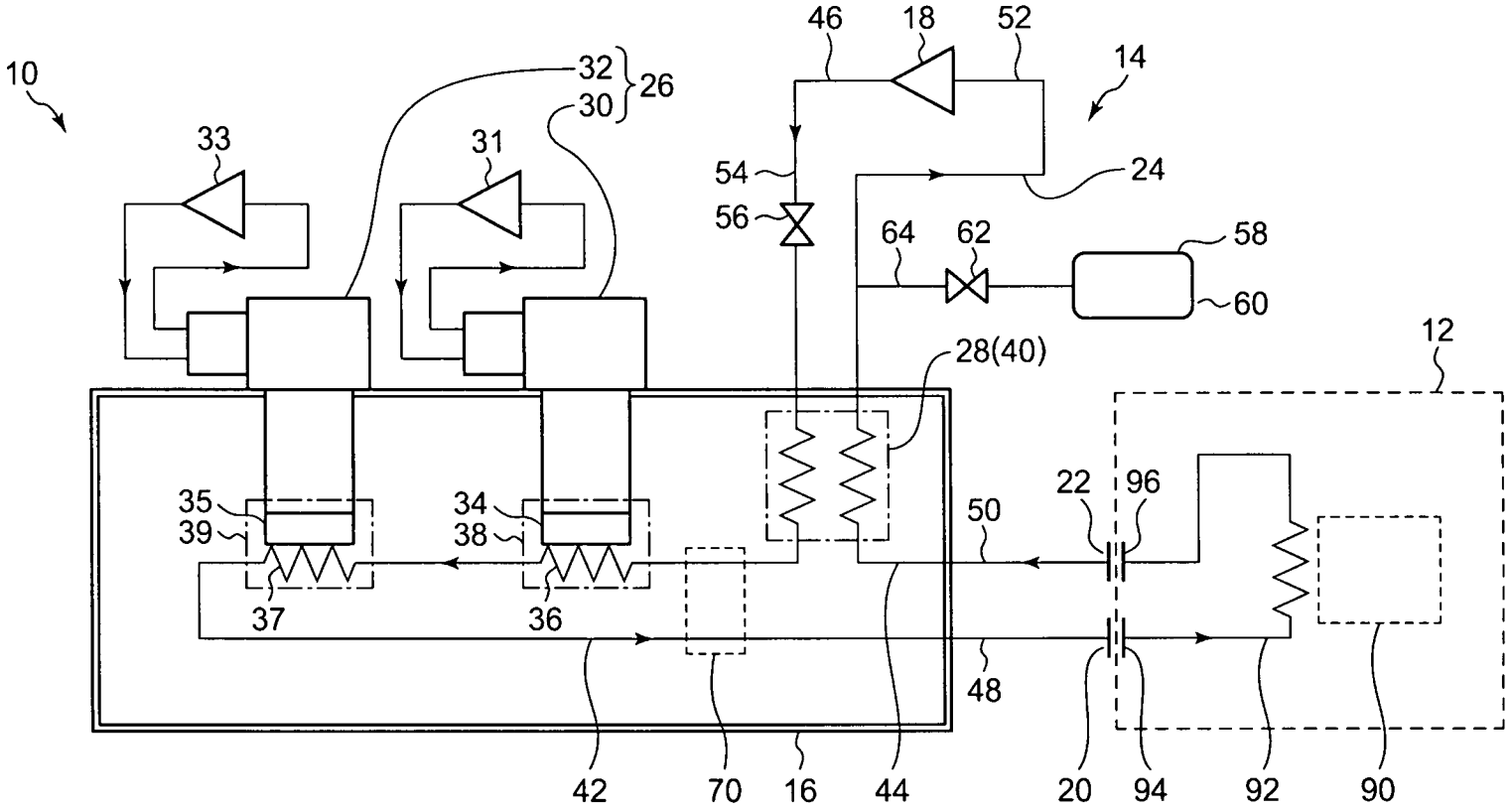
FIG. 1 schematically shows a cooling system according to an embodiment of the present invention.

FIG. 1 schematically shows a cooling system 10 according to an embodiment of the present invention. The cooling system 10 is a device for cooling a superconducting device 12 by supplying a low-temperature fluid as a coolant. The cooling system 10 is fitted to the superconducting device 12 so as to form a circulation pathway of a coolant. The cooling system 10 cools the superconducting device 12 by circulating the coolant in the circulation pathway. The coolant is exemplified by helium gas cooled to a low temperature. Alternatively, nitrogen, hydrogen, or neon may be used as a coolant.

The superconducting device 12 is a device in which a superconducting state need be maintained for operation and is exemplified by a superconducting magnet, a superconducting motor, a superconducting generator, etc. Alternatively, the superconducting device 12 may be a system including elements that utilize superconductivity. For example, the superconducting device 12 may be a magnetic resonance imaging device.

The superconducting device 12 includes a component to be cooled 90 that should be cooled by the cooling system 10, and a cooling pipe 92 for distributing the coolant in order to cool the component to be cooled 90. If the superconducting device 12 is a superconducting magnet, the component to be cooled 90 includes a superconducting coil. If the superconducting device 12 is a superconducting motor or a superconducting generator, the component to be cooled 90 includes a superconducting rotor. The cooling pipe 92 is formed inside the superconducting device 12 and the component to be cooled 90, or in the neighborhood of the component to be cooled 90, in order to cool the component to be cooled 90. One end 94 of the cooling pipe 92 is configured to be connected to a coolant outlet 20 of the cooling system 10, and the other end 96 of the cooling pipe 92 is configured to be connected to a coolant inlet 22 of the cooling system 10.

In one exemplary embodiment, the superconducting device 12 may be provided with a separate cooling system independent of the cooling system 10, and the cooling system 10 may be used to precool the superconducting device 12 to a temperature at which the cooling by the separate cooling system is started. The separate cooling system may be a cooling device configured to immerse the component to be cooled 90 of the superconducting device 12 in an extremely low temperature liquid for cooling. In this case, the cooling system 10 may be used to precool the component to be cooled 90 of the superconducting device 12 to a temperature range between 20K and 80K, and, preferably, between 30K and 50K. After the superconducting device 12 is precooled by the cooling system to a temperature at which the cooling by the separate cooling system is started, the separate cooling system starts primary cooling of the superconducting device 12.

The cooling system 10 comprises a coolant circuit 14 for channeling a low-temperature fluid, a low-temperature chamber 16 in which a low temperature is maintained, and a flow generator 18 configured to produce a flow of coolant in the coolant circulation pathway of the coolant circuit 14. The coolant circuit 14 comprises a coolant outlet 20 for supplying a low-temperature fluid to the superconducting device 12, a coolant inlet 22 for receiving the low-temperature fluid flowing through the superconducting device 12, and a coolant line 24 for connecting the coolant inlet 22 and the coolant outlet 20. The coolant outlet 20 and the coolant inlet 22 are joined to the end 94 and the other end 96 of the cooling pipe 92 via a known bayonet joint. As illustrated below, the coolant line 24 forms a coolant circulation pathway by being connected to the cooling pipe 92 of the superconducting device 12 via the coolant outlet 20 and the coolant inlet 22.

For example, the low-temperature chamber 16 is a cryostat configured to maintain a low-temperature environment inside by vacuum insulation. The low-temperature chamber 16 is installed in an environment of a room temperature or a normal temperature. Therefore, the environment outside the low-temperature chamber 16 is at a room temperature or a normal temperature. The flow generator 18 is provided outside the low-temperature chamber 16. The guaranteed operating temperature range in which normal operation is guaranteed is defined in the specifications of the flow generator 18. For example, the guaranteed operating temperature range includes a room temperature or a normal temperature. For example, the guaranteed operating temperature range is between 5° C. and 40° C. For example, the flow generator 18 is a compressor. In one exemplary embodiment, the flow generator 18 may be a fan, a circulator, a blower, or a pump.

The cooling system 10 is provided with a cooling device 26 for cooling the coolant. The cooling device 26 includes a first cooler 30 and a second cooler 32. For example, the first cooler 30 and the second cooler 32 may be a single-stage GM refrigerator. A cooling stage 34 of the first cooler 30 and a cooling stage 35 of the second cooler 32 are provided inside the low-temperature chamber 16. The first cooler 30 and the second cooler 32 are controlled by a controller (not shown) to cool the respective cooling stages to a desired cooling temperature selected from a range between, for example, 10K and 100K.

A part 36 of the coolant line 24 is fitted to the cooling stage 34 of the first cooler 30, a part 37 downstream of the part 36 is fitted to the cooling stage 35 of the second cooler 32. The cooling stage 34 of the first cooler 30 and the part 36 of the coolant line 24 fitted to the stage 34 form a cooling heat exchanger 38 for cooling the coolant. Similarly, the cooling stage 35 of the second cooler 32 and the part 37 of the coolant line 24 fitted to the stage 35 form another cooling heat exchanger 39 for cooling the coolant. Therefore, by sequentially exchanging heat with the cooling stages 34 and 35 in the two heat exchangers 38 and 39, the coolant flowing in the coolant line 24 is cooled. The cooling temperature of the second cooler 32 is either equal to the cooling temperature of the first cooler 30 or lower than the cooing temperature of the first cooler 30.

A first compressor 31 and a second compressor 33 are respectively coupled to the first cooler 30 and the second cooler 32 of the cooling device 26. The first compressor 31 compresses a low-pressure working gas expanded in the first cooler 30 and feeds the high-pressure working gas back to the first cooler 30. Similarly, the second compressor 33 compresses a low-pressure working gas expanded in the second cooler 32 and feeds the high-pressure working gas back to the second cooler 32. The first compressor 31 and the second compressor 33 are located outside the low-temperature chamber 16. In this exemplary embodiment, the circulation pathway of the working fluid of the cooling device 26 is isolated from the circulation pathway of the coolant in the cooling system 10. The first cooler 30 and the second cooler 32 may share a single compressor.

If the flow generator 18 is implemented by a compressor, the first compressor 31 and the second compressor 33 may be a compressor of the same type as the compressor as the flow generator 18. In this case, first and second compressors 31 and 33 are operated at an operating pressure different from that of the compressor as the flow generator. The pressure at the high-pressure side of the compressor as the flow generator 18 is configured to be lower than the pressure at the high-pressure side of the first and second compressors 31 and 33.

The cooling device 26 may be any cooling device capable of cooling a low-temperature fluid as a coolant to a desired cooling temperature. For example, instead of comprising two coolers, the cooling device may be provided with a single cooler or three or more coolers. The coolers may be a cooler other than a single-stage GM refrigerator. For example, a two-stage GM refrigerator may be used. Alternatively, a pulse tube refrigerator or a Stirling refrigerator may be used. Still alternatively, a low-temperature liquid generator or a low-temperature liquid reservoir may be used in place of a cryogenic refrigerator that produces coldness by expansion of a working gas. In this case, at least one of the first cooler 30 and the second cooler 32 may be replaced by a low-temperature liquid generator or a low-temperature liquid reservoir, according to one exemplary embodiment. The low-temperature liquid generator or the low-temperature liquid reservoir liquefies a coolant gas by exchanging heat with the coolant gas. The extremely low-temperature liquid that serves as a cooling source in the low-temperature liquid generator or the low-temperature liquid reservoir may be liquid helium or liquid nitrogen.

The cooling system 10 is further provided with a heating device 28 for heating the coolant flowing through the superconducting device 12. The heating device 28 includes a heat exchanger 40 for heating the coolant by exchanging heat with the coolant. The heat exchanger 40 is configured to heat the low-temperature fluid that has cooled the superconducting device 12 to a guaranteed operating temperature of the flow generator 18. The heat exchanger 40 used the fluid fed from the flow generator 18 to the cooling device 26 as a heat source to heat the low-temperature fluid. For example, the heat exchanger 40 may be implemented by a stacked heat exchanger. A stacked heat exchanger excels in the efficiency of exchanging heat and so is capable of heating the low-temperature fluid to substantially the same temperature as the coolant at a room temperature flowing into the stacked heat exchanger as a heat source.

The heat exchanger 40 may be configured to heat the low-temperature fluid by using outside air as a heat source. In this case, the heat exchanger 40 is configured to flow outside air through the pathway at the high-temperature side. For this purpose, a fan for blowing the air into the pathway of the heat exchanger 40 at the high temperature side may additionally be provided in the heat exchanger 40.

The heat exchanger 40 may not necessarily be a stacked heat exchanger but can be of other types. For example, the heat exchanger 40 may be a tube-in-tube heat exchanger. When a heat exchanger of a relatively simple configuration such as this is used, a plurality of heat exchangers may be provided in series in order to improve the efficiency of heat exchange.

In this exemplary embodiment, the heating device 28 is accommodated in the low-temperature chamber 16. Alternatively, at least a part of the heating device 28 may be provided outside the low-temperature chamber 16. According to one exemplary embodiment, a heater for heating the coolant discharged from the heating heat exchanger 40 to the flow generator 18 may be provided in order to guarantee that the coolant is heated to the guaranteed operating temperature of the flow generator 18. The heater may be provided between the heating heat exchanger 40 and the flow generator 18 and outside the low-temperature chamber 16.

The coolant line 24 includes a low-temperature part for channeling the coolant cooled to the cooling temperature of the component to be cooled, and a high-temperature part for channeling the coolant heated to the guaranteed operating temperature of the flow generator 18. The low-temperature part of the coolant line 24 includes a first part 42 upstream of the coolant outlet 20, and a second part 44 downstream of the coolant inlet 22. The high-temperature part of the coolant line 24 includes a third part 46 connecting the first part 42 and the second part 44. The third part 46 is provided outside the low-temperature chamber 16. Consequently, the coolant flowing from the coolant inlet 22 to the coolant line 24 flows through the second part 44, the third part 46, and the first part 42 in the stated order and is drained from the coolant outlet 20.

The first part 42 of the low-temperature part is provided with the aforementioned cooling heat exchangers 38 and 39. The high-temperature side pathway of the heating heat exchanger 40 is provided in the middle of the first part 42, and the low-temperature side pathway of the heating heat exchanger 40 is provided in the middle of the second part 44. The cooling heat exchangers 38 and 39 and the heating heat exchanger 40 are accommodated in the low-temperature chamber 16.

The low-temperature part of the coolant line 24 is accommodated in the low-temperature chamber 16 except for the ends thereof in the neighborhood of the coolant outlet 20 and the coolant inlet 22. An outlet pipe 48 at the end of the coolant line in the neighborhood of the coolant outlet 20 extends outward from the low-temperature chamber 16. An inlet pipe 50 at the end of the coolant line in the neighborhood of the coolant inlet 22 extends outward from the low-temperature chamber 16. The outlet pipe 48 and the inlet pipe 50 are formed to have heat insulation capability and implemented by, for example, a vacuum insulation pipe. The ends of the outlet pipe 48 and the inlet pipe 50 are formed as the coolant outlet 20 and the coolant inlet 22, respectively.

The third part 46 of the high-temperature part includes a return pipe 52 for returning the coolant to the flow generator 18, and a supply pipe 54 for supplying the coolant from the flow generator 18. One end of the return pipe 52 is connected to the low-temperature chamber 16 (more specifically, the second part 44 of the coolant line 24), and the other end of the return pipe 52 is connected to the low-pressure side of the flow generator 18. One end of the supply pipe 54 is connected to the low-pressure chamber 16 (more specifically, the first part 42 of the coolant line 24), and the other end is connected to the high-pressure side of the flow generator 18. The return pipe 52 and the supply pipe 54 may be a pipe having heat insulating capability equal to or lower than that of the outlet pipe 48 and the inlet pipe 50. For example, the return pipe 52 and the supply pipe 54 may be a flexible hose.

A pressure adjustment valve 56 for reducing the pressure of the high-pressure fluid discharged from the flow generator 18 is provided outside the low-temperature chamber 16 and downstream of the flow generator 18. The pressure adjustment valve 56 is provided in the middle of the supply pipe 54. The pressure adjustment valve 56 may be configured to mechanically reduce the input pressure to a desired preset pressure. Alternatively, the pressure may be lowered to the preset pressure by controlling the valve lift of the pressure adjustment valve 56. For example, the preset pressure may be lower than the maximum pressure permitted for the cooling pipe 92 of the superconducting device 12 or for the connecting mechanism connecting the superconducting device 12 and the cooling system 10.

This is suitable in the case that a compressor configured to feed a fluid of a relatively high pressure is used as the flow generator 18. In this case, the preset pressure of the pressure adjustment valve 56 is preferably set to approximately ⅓ to 1/10 of the working gas pressure at the high-pressure side of the first cooler 30 and the second cooler 32. This ensures a low pressure of coolant in the cooling pipe 92 in the superconducting device 12 and a compact size of the cooling pipe 92. If the flow generator configured to feed a fluid of a relatively low pressure is used, the pressure adjustment valve 56 may not be provided.

The coolant circuit 14 is provided with a coolant supplier 58 for supplying a coolant to the coolant line 24. The coolant supplier 58 is configured to include a buffer tank 60 for storing a coolant, and a check valve 62 for prevent back flow from the coolant line 24 to the buffer tank 60. The coolant supplier 58 is provided in a branch pipe 64 branching from the middle of the return pipe 52. The check valve 62 and the buffer tank 60 are provided in series in the branch pipe 64, and the buffer tank 60 is connected at the end of the branch pipe 64. The check valve 62 is closed when the pressure in the return pipe 52 is higher than the desired preset pressure and opened when the pressure in the return pipe 52 is lower than the preset pressure. Therefore, the coolant is supplied from the buffer tank 60 the return pipe 52 when the pressure in the return pipe 52 is lower than the preset pressure so that the pressure in the return pipe 52 is returned to the preset pressure.

The coolant supplier 58 may be provided in the supply pipe 54. In this case, the coolant supplier 58 may be provided upstream of the pressure adjustment valve 56 or downstream thereof. Alternatively, the coolant supplier 58 may be accommodated in the low-temperature chamber 16 and provided in the first part 42 or the second part 44 of the coolant line 24. By locating the coolant supplier 58 in a low-temperature environment, the volume of the buffer tank 60 can be reduced.

A description will now be given of the operation of the cooling system 10 structured as described above. According to one exemplary embodiment, the cooling system 10 is used to precool the superconducting device 12 (e.g., an MRI device) when the device 12 is installed in a location such as a hospital. In this case, primary cooling (e.g., cooling during operation) is performed by immersing the component to be cooled 90 in the superconducting device 12 in an extremely low-temperature liquid (e.g., helium).

To start precooling, the cooling system 10 is fitted to the superconducting device 12. More specifically, the coolant outlet 20 and the coolant inlet 22 of the coolant line 24 are connected to the cooling pipe 92 of the superconducting device 12. The cooling device 26 and the flow generator 18 of the cooling system 10 are then started.

By activating the cooling device 26 and the flow generator 18, the coolant is cooled. When the operation is started, the coolant pressure in the coolant line 24 tends to be decreased transiently. The coolant is supplied from the coolant supplier 58 to prevent the coolant pressure from falling below the preset pressure. Even after the system reaches a steady operation state, the coolant is supplied from the coolant supplier 58 to prevent the coolant pressure of the coolant line 24 from falling below the preset pressure due to, for example, leakage of the coolant.

The low-temperature fluid cooled by the cooling device 26 is supplied to the superconducting device 12 via the first part 42 of the coolant line 24, the outlet pipe 48, and the coolant outlet 22. The low-temperature fluid that has passed through the component to be cooled 90 via the cooling pipe 92 of the superconducting device 12 is discharged from the superconducting device 12 to the coolant inlet 22 of the cooling system 10. The low temperature fluid flowing into the coolant inlet 22 flows to the flow generator 18 via the inlet pipe 50, the second part 44, and the return pipe 52. The heating heat exchanger 40 provided in the second part 44 of the coolant line 24 heats the low-temperature fluid to a high temperature approximating a room temperature and feeds the heated fluid outside the low-temperature chamber 16.

The pressure of the low-temperature fluid at a temperature approximating a room temperature discharged from the flow generator 18 is adjusted by the pressure adjustment valve 56. The low-temperature fluid is then supplied to the heating heat exchanger 40. It can be said that the low-temperature fluid fed from the flow generator 18 is precooled in the heating heat exchanger 40 by the low-temperature fluid returned from the superconducting device 12. The low-temperature fluid flowing through the heating heat exchanger 40 is cooled by the cooling device 26. In this way, the low-temperature fluid is circulated in the cooling system 10 and the superconducting device 12.

According to one embodiment of the present invention, the component to be cooled 90 can be precooled to a temperature at which primary cooling is started. Therefore, the amount of extremely low-temperature liquid for primary cooling can be reduced as compared with the case where primary cooling is started without precooling the superconducting device 12 as installed. Further, preliminary cooling performed while the coolant is circulated in the closed-loop circulation pathway helps reduce the amount of extremely low-temperature liquid used.

According to one embodiment of the present invention, mechanical elements such as the flow generator 18, the pressure adjustment valve 56, and the check valve 62 of the coolant supplier 58 are provided in a room temperature environment outside the low-temperature chamber 16. Therefore, it is not necessary to use specially designed products capable withstanding an extremely low temperature to implement these mechanical elements. As a result, the reliability of the cooling system 10 is improved. Further, since general-purpose mechanical elements guaranteed to operate in a room temperature can be used, the embodiment is more cost-saving than when products especially designed for a low temperature are used.

According to one embodiment, the cooling system 10 may be used for primary cooling of the superconducting device 12 provided with a rotating member as the component to be cooled 90. In this case, the coolant outlet 20 and the coolant inlet 22 of the coolant line 24 may be provided with a connecting mechanism connecting the superconducting device 12 to the coolant circuit 14 such that rotation in the superconducting device 12 is permitted. In one exemplary embodiment, the coolant outlet 20 and the coolant inlet 22 may be a bayonet joint configured to be rotatable around an axis along the direction of piping (see FIG. 2). In this way, the coolant line 24 of the cooling system 10 can be connected to the cooling pipe 92 of the superconducting device 12 such that rotation of the component to be cooled 90 is permitted.

Figure 2:
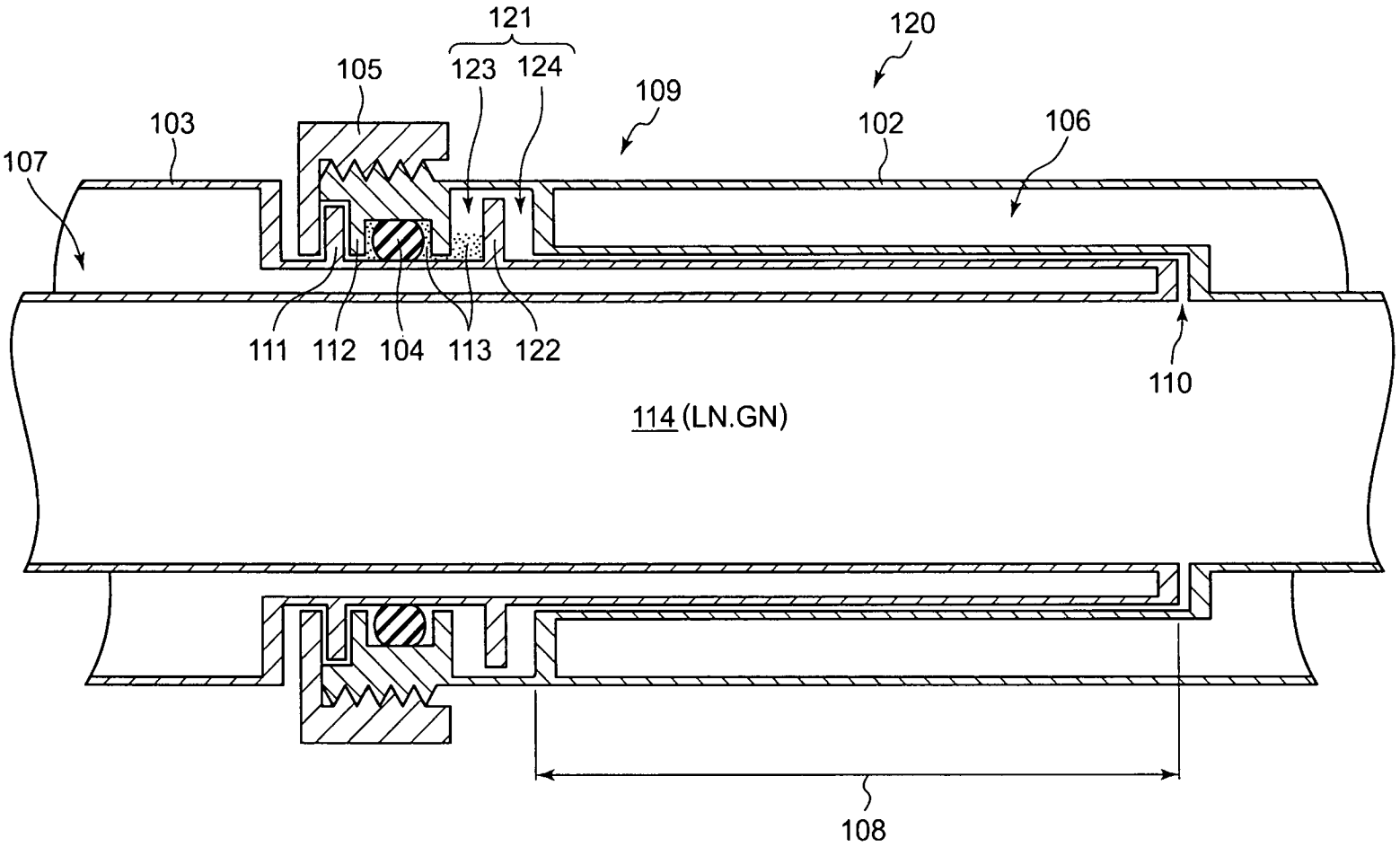
FIG. 2 shows an example of connecting mechanism used in the cooling system according to an embodiment.

FIG. 2 shows an exemplary connecting mechanism used in the cooling system according to one embodiment of the present invention. A low-temperature fluid bayonet joint 120 comprises a combination of a first heat insulation pipe 102 and a second heat insulation pipe 103 and further comprises an O ring 104 (seal member) and a cap nut 105. The first heat insulation pipe 102 is of double tube structure containing first heat insulation vacuum 106. The second heat insulation pipe 103 is also of double tube structure containing second heat insulation vacuum 107. The end of the first heat insulation pipe 102 has a concavity. The convex end of the second heat insulation pipe 103 is inserted in the concavity by a predetermined length (a bayonet part 108) so as to form a rotary joint 109. A small gap located where engagement occurs is used as an auxiliary heat insulation part 110.

The O ring 104, a dislodgement prevention stopper 111 and a dislodgement prevention flange 112 for preventing the bayonet part 108 from being dislodged, and the cap nut 105 are provided at the innermost part (room temperature side) of the auxiliary heat insulation part 110. Therefore, the first heat insulation pipe 102 and the second heat insulation pipe 103 are axially integrated and are not moved relative to each other. A small gap (the auxiliary heat insulation part 110) permits relative rotation in the rotary joint 109 (the bayonet part 108).

By coating the O ring 104, the dislodgement prevention stopper 111 and the dislodgement stopper 112 with grease 113, lubrication is provided to secure rotation of the first heat insulation pipe 102 and the second heat insulation pipe 103. To allow rotation of the first heat insulation pipe 102 or the second heat insulation pipe 103, the cap nut 105 may be loosened.

The first heat insulation pipe 102 and the second heat insulation pipe 103 form a low-temperature fluid pathway 114. The low-temperature fluid pathway 114 is capable of supplying a low-temperature fluid (e.g., helium or liquid nitrogen LN) in one direction within the low-temperature fluid pathway 114, cooling an object to be cooled (not shown), and feeding back the fluid mixed with nitrogen gas GN produced by thermal contact with the object to be cooled. Of course, a liquid supply pipe (not shown) may be provided at the center of the low-temperature fluid pathway 114 so that a supply passage is defined in the fluid supply pipe and a space between the fluid supply pipe and the first and second heat insulation pipes 102 and 103 is used as a feedback passage.

The nitrogen gas GN may leak outside from the auxiliary heat insulation part 110. However, the O ring 104 provides sealing and there is only a slight gap in the auxiliary heat insulation part 110 so that the nitrogen gas GN entering the space can hardly convect in the presence of a small temperature difference. The low-temperature nitrogen gas GN can provide heat insulation. Further, the neighborhood of the O ring 104 is at a room temperature so that the O ring 104 is not frozen and can be lubricated by means of, for example, the grease 113. Moreover, by using a thin stainless steel material to form the first and second heat insulation pipes 102 and 103, the heat entering the low-temperature part via the pipes can be significantly reduced.

Even in the presence of a pressure in the low-temperature fluid, the bayonet part 108 is prevented from coming off or being dislodged due to the pressure because the dislodgement prevention stopper 111 and the dislodgement prevention flange 112 are engaged with each other and latched by the cap nut 105.

Transfer piping of a low-temperature fluid (cooling medium) can be built in a three-dimensional space by linearly arranging the low-temperature fluid bayonet joints 120 as described above. Alternatively, a multiple joint link may be built by bending the first heat insulation pipe 102 or the second heat insulation pipe 103 in the middle at an arbitrary angle (e.g., at a right angle) and using a large number of low-temperature fluid bayonet joints 120 in combination. Since rotation in the rotary joint 109 is enabled, the cooling medium can be transferred to keep track of the movement of the object to be cooled over an arbitrary range.

The low-temperature fluid bayonet joint 120 is provided with an annular grease reservoir space 121 at the low-temperature side of the O ring 104 between the first heat insulation pipe 102 and the second heat insulation pipe 103 (the low-temperature side away from the inlet of the first heat insulation pipe 102 in a direction along the auxiliary heat insulation part 110).

The grease reservoir space 121 is formed adjacent to the O ring 104 in a direction toward the auxiliary heat insulation part 110. By further providing a circumferential projection 122 at the center of the grease reservoir space 121, the grease reservoir space 121 is halved so as to define a primary reservoir space 123 and an auxiliary reservoir space 124, further preventing the grease 113 from entering the low-temperature side. In other words, the grease reservoir space 121 is provided in the auxiliary heat insulation part 110 between the first heat insulation pipe 102 and the second heat insulation pipe 103 so as to extend a leakage path of the grease 113 between the first heat insulation pipe 102 and the second heat insulation pipe 103.

By providing the low-temperature fluid bayonet joint 120 with the grease reservoir space 121 for prevention of freezing between the first heat insulation pipe 102 and the second heat insulation pipe 103, travel of the grease 113 from the rotary joint 109 (where the O ring 104 and the grease 113 are) to the low-temperature side is prevented due to the space 121 so that freezing of the grease 113 is prevented. Therefore, the disadvantage as already described can be avoided even if a relatively large amount of grease 113 is used. As a result, shortage of oil at the O ring 104 is prevented, sealing performance is improved, wear of the O ring 104 is prevented, required driving power can be reduced, and high reliability and durability can be ensured.

Figure 3:
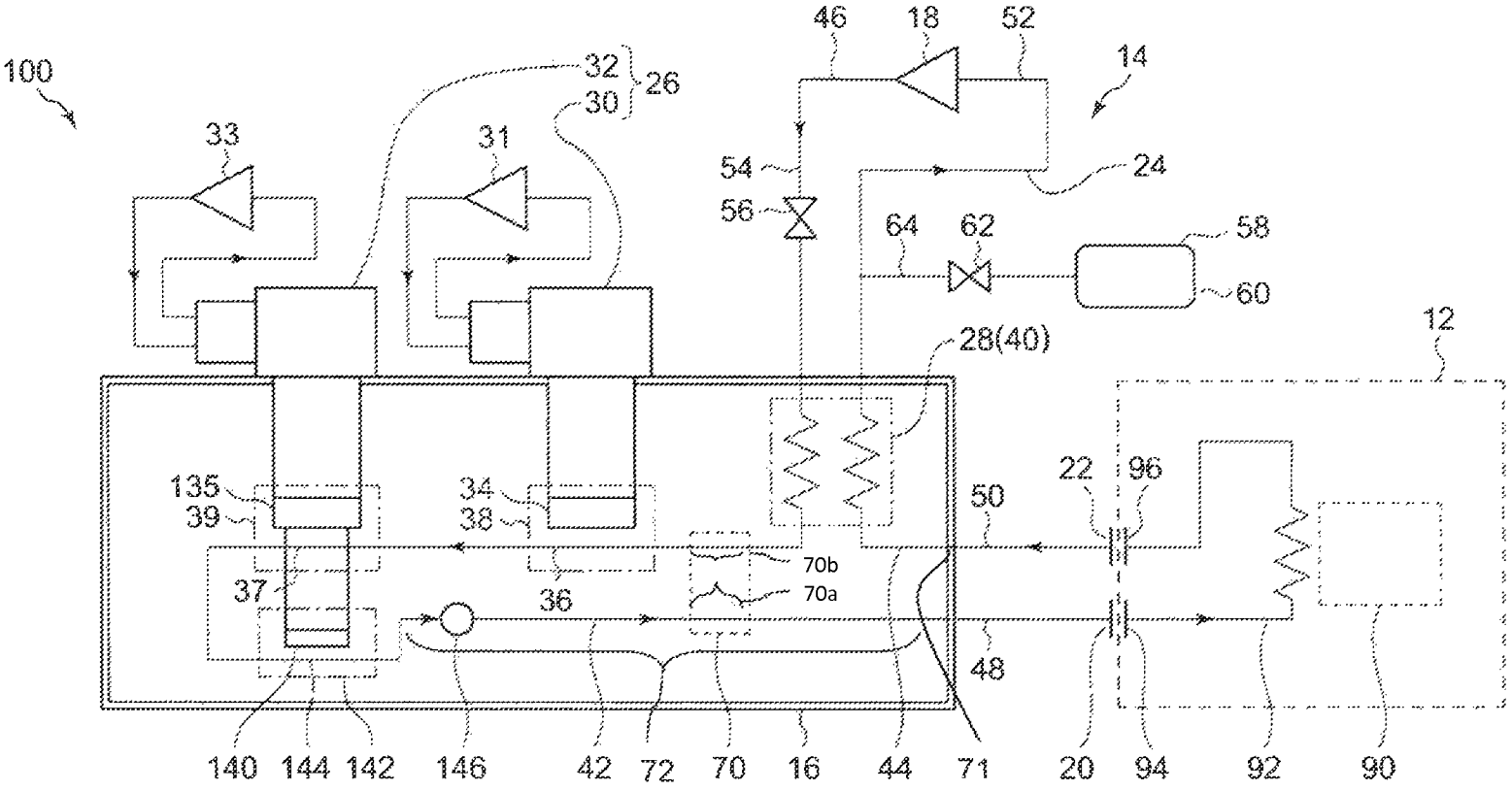
FIG. 3 schematically shows a cooling system according to another embodiment of the present invention.

FIG. 3 schematically shows the cooling system 100 according to another embodiment of the present invention. The cooling system 10 shown in FIG. 1 supplies a gas coolant to the component to be cooled 90. A cooling system 100 shown in FIG. 3 differs in that it is configured to supply a liquid coolant at an extremely low temperature. For this purpose, the cooling system 100 is provided with a two-stage GM refrigerator as the second cooler 32 of the cooling device 26. The cooling device 26 cools and liquefies the low-temperature fluid. The heating device 28 heats the fluid and returns the fluid to a gas. In the following description, like numerals denote like components which are also used in the aforementioned exemplary embodiment to avoid redundancy, and a description of those components will be omitted. Variations described in connection with the exemplary embodiment shown in FIG. 1 may also be applicable to the exemplary embodiment shown in FIG. 3.

As illustrated, the second cooler 32 is provided with a first stage 135 and a second stage 140 cooled to a lower temperature than the first stage 135. For example, the first stage 135 is cooled to 30K through 70K, and the second stage 140 is cooled to a temperature lower than the liquefaction temperature of the coolant. For example, the second stage 140 is cooled to about 4K if the coolant is helium. As in the exemplary embodiment shown in FIG. 1, the first stage 135 of the second cooler 32 may be cooled to a temperature lower than that of the cooling stage 34 of the first cooler 30.

The second stage 140 of the second cooler 32 provides an additional cooling heat exchanger 142. The second stage 140 is fitted with a part 144 of the coolant line 24 downstream of a part 37 of the coolant line 24 fitted to the first stage 135. Thus, the second stage 140 and the part 144 of the coolant line 24 form the heat exchanger 142 for liquefying the coolant.

In the first part 42 of the coolant line 24, a pump 146 is provided downstream of the heat exchanger 142 for liquefaction. The pump 146 is provided to feed the liquefied coolant toward the coolant outlet 20.

The extremely low temperature liquid fed from the coolant outlet 20 to the cooling pipe 92 of the superconducting device 12 cools the component to be cooled 90 and at least a portion of the liquid is gasified. The gas-liquid mixture fluid thus generated is returned to the heating device 28 via the coolant inlet 22. The heating device 28 completely gasifies the gas-liquid mixture fluid and heats the coolant to the guaranteed operating temperature of the flow generator 18. The heated coolant is collected by the flow generator 18 as in the exemplary embodiment shown in FIG. 1 and fed to the cooling device 26 again. In this way, the low temperature fluid is circulated in the cooling system 10.

Described above is an explanation based on an exemplary embodiment. The embodiment is intended to be illustrative only and it will be obvious to those skilled in the art that various modifications to constituting elements and processes could be developed and that such modifications are also within the scope of the present invention.

As shown in FIGS. 1 and 3, an additional heat exchanger 70 may be provided in the coolant circuit 14. The heat exchanger 70 exchanges heat between the low-temperature side, which is fed with the coolant cooled by the cooling device 26 in the first part 42 of the coolant line 24, and the high-temperature side, which is fed with the coolant flowing through the heating device 28 in the first part 42 of the coolant line 24 and yet to be cooled by cooling device 26. In other words, the low-temperature side pathway of the heat exchanger 70 is provided downstream of the cooling device 26 in the first part 24 of the coolant line 24, and the high-temperature side pathway is provided upstream of the cooling device 26. The heat exchanger 70 is accommodated inside the low-temperature chamber 16. In this way, the temperature of the coolant flowing into the cooling heat exchanger 38 can be reduced so that the efficiency of the cooling system 100 as a whole can be improved.

A coldness storage (not shown) may be coupled to the cooling device 26 or provided in the coolant circuit 14. The coldness storage is configured to store the coldness produced by the cooling device 26 or the coldness of the cooled coolant. For example, the coldness storage is provided downstream of the cooling device 26 in the first part 42 of the coolant 24 and is accommodated in the low-temperature chamber 16. In this way, the coldness of the coolant cooled by the cooling device 26 is maintained in the coldness storage. This allows the operation of the cooling system to continue by using the coldness maintained, even when the operation of the cooling device 26 is temporarily suspended for maintenance or when the cooling device 26 is abnormally stopped. The fail-safe capability of the cooling system is improved. An exemplary embodiment in which a coldness storage is installed is particularly favorable if the cooling system is used for primary cooling of the component to be cooled.

According to one exemplary embodiment, the cooling system 10 may be configured to circulate the working gas of the cooler used in the cooling device 26 as a coolant. In this case, the flow generator 18 may be implemented by a compressor and the cooling device 26 may be implemented by an expansion engine. The compressors 31 and 33 of the cooling device 26 are not provided. In this way, the number of compressors used in the cooling system 10 can be reduced.

It should be understood that the invention is not limited to the above-described embodiment, but may be modified into various forms on the basis of the spirit of the invention. Additionally, the modifications are included in the scope of the invention.

Priority is claimed to International Patent Application No. PCT/JP2010/002945, filed Apr. 23, 2010, the entire content of which is incorporated herein by reference.

What is claimed is:

1. A cooling system for cooling a superconducting device or component, the cooling system comprising:

a liquid outlet configured to supply a liquefied coolant fluid to the superconducting device or component;

a gas-liquid mixture inlet configured to receive a gas-liquid mixture coolant fluid flowing from the superconducting device or component;

a coolant line connecting the gas-liquid mixture inlet to the liquid outlet and comprising a gas outlet, a gas inlet, a first coolant line part connecting the gas inlet to the liquid outlet, a second coolant line part connecting the gas-liquid mixture inlet to the gas outlet, and a third coolant line part connecting the gas outlet to the gas inlet;

a low-temperature chamber configured to accommodate the first coolant line part and the second coolant line part, wherein the third coolant line part is provided outside the low-temperature chamber;

a cooling device comprising at least one cooling stage provided inside the low-temperature chamber and thermally coupled to the first coolant line part such that a gaseous coolant fluid flowing from the gas inlet through the first coolant line part is liquefied to generate the liquefied coolant fluid;

a heating device provided inside the low-temperature chamber and thermally coupled to the second coolant line part such that the gas-liquid mixture coolant fluid is completely gasified to the gaseous coolant fluid; and a flow generator arranged on the third coolant line part to generate a flow of the gaseous coolant fluid in the third coolant line part, wherein the cooling device comprises a single stage refrigerator comprising a first cooling stage and a two-stage refrigerator comprising a first cooling stage and a second cooling stage, the first cooling stage of the single stage refrigerator, the first cooling stage of the two-stage refrigerator and the second cooling stage of the two-stage refrigerator arranged in series along the first coolant line part.

2. The cooling system according to claim 1, further comprising a pump arranged on the first coolant line part to feed the liquefied coolant fluid to the liquid outlet.

3. The cooling system according to claim 1, further comprising a pressure adjustment valve arranged on the third coolant line to reduce a pressure of the gaseous coolant fluid flowing from the flow generator to a desired preset pressure.

4. The cooling system according to claim 1, wherein at least one of the liquid outlet and the gas-liquid mixture inlet comprises a bayonet joint for connecting the superconducting device to the coolant line such that rotation in the superconducting device is permitted.

5. A cooling system for cooling a superconducting device or component, the cooling system comprising:

a liquid outlet configured to supply a liquefied coolant fluid to the superconducting device or component;

a gas-liquid mixture inlet configured to receive a gas-liquid mixture coolant fluid flowing from the superconducting device or component;

a coolant line connecting the gas-liquid mixture inlet to the liquid outlet and comprising a gas outlet, a gas inlet, a first coolant line part connecting the gas inlet to the liquid outlet, a second coolant line part connecting the gas-liquid mixture inlet to the gas outlet, and a third coolant line part connecting the gas outlet to the gas inlet;

a low-temperature chamber configured to accommodate the first coolant line part and the second coolant line part, wherein the third coolant line part is provided outside the low-temperature chamber;

a cooling device comprising at least one cooling stage provided inside the low-temperature chamber and thermally coupled to the first coolant line part such that a gaseous coolant fluid flowing from the gas inlet through the first coolant line part is liquefied to generate the liquefied coolant fluid;

a heating device provided inside the low-temperature chamber and thermally coupled to the second coolant line part such that the gas-liquid mixture coolant fluid is completely gasified to the gaseous coolant fluid; and a flow generator arranged on the third coolant line part to generate a flow of the gaseous coolant fluid in the third coolant line part, wherein the first coolant line part comprises a heat source portion of the heating device arranged between the gas inlet and the at least one cooling stage and thermally coupled to the second coolant line part, a gaseous coolant conveying portion arranged directly downstream of the heat source portion and upstream of the at least one cooling stage, and a liquefied coolant conveying portion arranged directly downstream of the at least one cooling stage and thermally coupled to the gaseous coolant conveying portion.

6. The cooling system according to claim 5, wherein the cooling device comprises a first single stage refrigerator comprising a first cooling stage and a second single stage refrigerator comprising a second cooling stage, the first cooling stage and the second cooling stage arranged in series along the first coolant line part.

* * * * *